United States Patent [19]

Kirkwood

[11] 4,323,353

[45] Apr. 6, 1982

[54] BOAT STEERING APPARATUS

[75] Inventor: Creal E. Kirkwood, Wagoner, Okla.

[73] Assignee: Incom International, Inc., Pittsburgh, Pa.

[21] Appl. No.: 226,467

[22] Filed: Jan. 19, 1981

Related U.S. Application Data

[63] Continuation of Ser. No. 55,615, Jul. 9, 1979, abandoned.

[51] Int. Cl.[3] ..... B63H 25/42

[52] U.S. Cl. ..... 440/63; 114/144 R

[58] Field of Search ..... 440/53, 62, 63; 114/144 R, 152, 162, 164, 167; 244/82; 74/480 B

[56] References Cited

U.S. PATENT DOCUMENTS

| | | | |
|---|---|---|---|
| 1,540,079 | 6/1925 | Luchsinger | 114/167 |
| 2,993,464 | 7/1961 | Conover | 440/62 |
| 3,149,605 | 9/1964 | Broadwell | 440/62 |
| 3,943,878 | 3/1976 | Kirkwood et al. | 440/63 |

*Primary Examiner*—Trygve M. Blix
*Assistant Examiner*—Jesus D. Sotelo
*Attorney, Agent, or Firm*—Head & Johnson

[57] ABSTRACT

An improved boat steering apparatus for an outboard or inboard-outboard type boat wherein a propeller assembly is turned about a vertical axis to steer the boat, comprising a slide tube having a horizontal opening, the slide tube being attached to the propeller assembly for applying steering force to the assembly and having a slot therein; a link arm having one end thereof slidably received in the opening in the slide tube, the other end being attached to a boat steering device, such as a steering wheel, whereby the arm is displaced axially in a horizontal plane for steering the boat; a fin supported about a vertical shaft in the propeller slip stream; a horizontal disc affixed to the fin shaft upper end; a pin affixed to the link arm and extending through the slot in the slide tube; and first and second cables, each having one end affixed to the pin and extending in opposed horizontal planes perpendicular to the pin, the other ends of the cable being attached opposite each other on the peripheral surface of the horizontal disc so that when the slide arm is moved to turn the propeller assembly the fin is first moved to react with the slip stream to augment turning of the propeller assembly for steering the boat.

11 Claims, 12 Drawing Figures

3A
3A

BOAT STEERING APPARATUS

This is a continuation application of Ser. No. 55,615, filed July 9, 1979 now abandoned.

BACKGROUND OF THE INVENTION

1. Field of the Invention

The invention is related to auxiliary means to improve the steering of outboard and inboard-outboard motor boats.

2. Description of the Prior Art

An outboard motor for use in propelling a boat is of the type wherein the motor is attached to the transom or rear end of a boat and pivoted about a vertical axis. The motor has a propeller at the lower end, and therefore the motor and propeller assembly turn as a unit. To steer the boat the entire unit is pivoted about its axis. When small boat motors are employed, the steering is usually accomplished manually by a steering arm extending in a horizontal plane from the motor so that the total motor is pivoted about by manipulation of steering arm. For larger motors it is common to employ remote steering means. This may be in the form of a steering wheel or steering stick having cables extending to the motor. When the steering wheel or stick is moved in one direction, the cables transmit the motion to the motor to move it and thereby steer the boat. Inboard-outboard motors have a separate propeller assembly which is pivoted about a vertical axis rearwardly of the boat transom. Power is supplied by a motor located within the boat through a gear arrangement. Steering is accomplished as with an outboard motor except that only the propeller assembly extending rearwardly of the boat is turned. Inboard-outboard type boats universally employ a steering means, usually a steering wheel.

As previously stated, with small outboard motors the steering can be accomplished manually but with large outboard motors and inboard-outboard motors a steering wheel or steering stick is employed. When the motors are exceedingly large and the motor thrusts are not excessive, steering can be accomplished without great difficulty. However, with large motors which generate high torque, steering requires a substantial mechanical force and steering becomes tiresome.

To assist steering of larger outboard motors and inboard-outboard boats it has been known to employ a fin located in the propeller slip stream. The fin reacts with the stream of water from the propeller and when turned at an angle, torque force is applied to the propeller assembly. Reference may be had to U.S. Pat. No. 3,943,879 entitled, "POWER STEERING SYSTEM FOR BOATS" for an example of the use of an auxiliary fin located in the propeller stream for steering a boat. Other references to the use of auxiliary fins are found in U.S. Pat. Nos. 3,149,605; 2,993,464; 1,116,749; 1,540,079.

These references show that thought has been previously given to improved steering of boats; however, with prior known devices, problems have existed which have not made them universally accepted. Particularly, prior known devices have not provided means for transmitting steering motion to fins in such a way as to eliminate slack or delayed response.

This invention overcomes this problem, and other objections to present-day steering systems and provides improved means of reducing the force required to steer a boat of the outboard or inboard-outboard type.

SUMMARY OF THE INVENTION

An improved means for reducing the force required to steer an outboard motor or inboard-outboard propeller assembly of a boat is provided. Outboard motors or the propeller assembly of inboard-outboard type motors rotate about a vertical axis. To provide means for achieving improved steering the invention makes use of a slide tube having a horizontal opening therein. The slide tube is attached to the propeller assembly either to the outboard motor or to the propeller assembly of an inboard-outboard type drive. The slide tube has a slot therein communicating with the horizontal opening. A link arm has one end slidably received in the opening in the slide tube. The other end of the link arm has means for attachment to a boat steering means such as a steering wheel operated assembly whereby the link arm is displaced axially in a horizontal plane for steering the boat. An auxiliary fin is supported on the bottom of a vertical shaft, and the shaft is rotatably supported to the propeller assembly whereby the fin is positioned rearwardly of the propeller to move in the propeller slip stream. A horizontal actuator plate is affixed to the shaft upper end and has a peripheral surface defined by opposed circular portions which are equidistant from the shaft axis. A pin is affixed to the link arm and extends through the slot in the slide tube allowing the pin to be displaced relative to the slide tube for a limited amount of axial motion before the axial force of the link arm is applied to the slide tube. A pin affixed to the link arm extends through the slot in the slide tube. One end of a first cable is attached to the pin and extends in the horizontal plane perpendicular to the pin in one direction relative to the slide tube and the other end of the cable connects to one side of the horizontal actuator plate periphery. One end of a second cable is attached to the pin and extends in the horizontal plane perpendicular to the pin in the opposite direction and the other end of the cable attaches to the opposite side of the horizontal actuator plate periphery. The cables are under tension so that the rotational position of the actuator plate and thereby the shaft and thereby the fin are controlled by the link arm. When the steering wheel or other guiding mechanism is actuated to turn the boat, thereby displacing the link arm, the sliding arrangement of the link arm with the slide tube applies force first to turn the auxiliary fin by means of the opposed cables. This force applies torque, by the reaction of the fin, to the slip stream of the propeller when the boat is moving, to rotate the boat propeller assembly in the required direction to effect the desired direction of movement. This rotational force is applied to the propeller assembly even before force is imparted to the propeller assembly by the link arm, thereby assisting the movement of the propeller assembly in the direction required to achieve steering of the boat.

DESCRIPTION OF THE VIEWS

DETAILED DESCRIPTION

Figure 1:
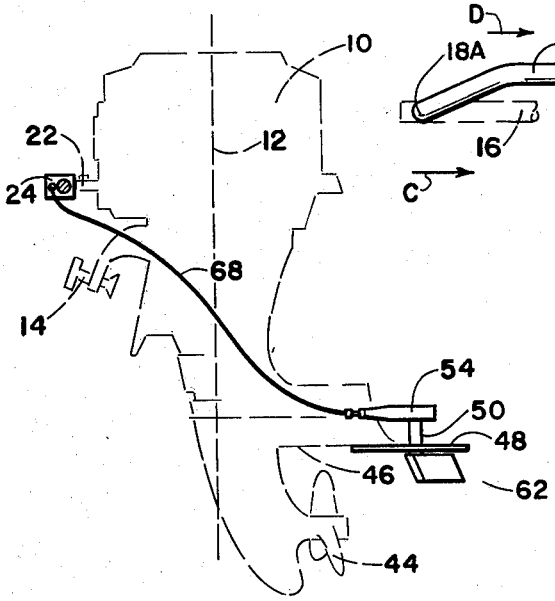
FIG. 1 is an elevational view of an outboard motor shown in dotted outline. Shown in solid line is the improved steering device of this invention as employed in conjunction with the outboard motor.

Referring first to FIG. 1, an outboard motor is shown in dotted outline and indicated generally by the numeral 10. The invention will be described as it is utilized in conjunction with an outboard motor, it being understood that it is equally applicable to inboard-outboard type drives in which the propeller assembly is located exteriorly of the boat and rotated about a vertical axis in the same way in which a typical outboard motor 10 rotates about a vertical axis indicated by the dotted line 12.

Motor 10 is affixed to a transom of a boat such as by means of clamps 14, and the boat is steered by rotating the motor 10. As previously indicated, when an outboard motor is of a small horsepower the typical means of steering is by a steering arm (not shown) extending from the motor 10 by which the motor is manually rotated. With larger size motors steering arms are not recommended, and instead, remote steering devices are employed. This usually includes a steering wheel or a steering stick for providing motion to pivot motor 10. This movement is usually transmitted by means of a cable arrangement to move laterally a link arm which is attached to the motor 10. The present invention provides a means of improving the steering of motor 10 when steered by a remote steering device utilizing the lateral movement of a link arm.

Figure 2:
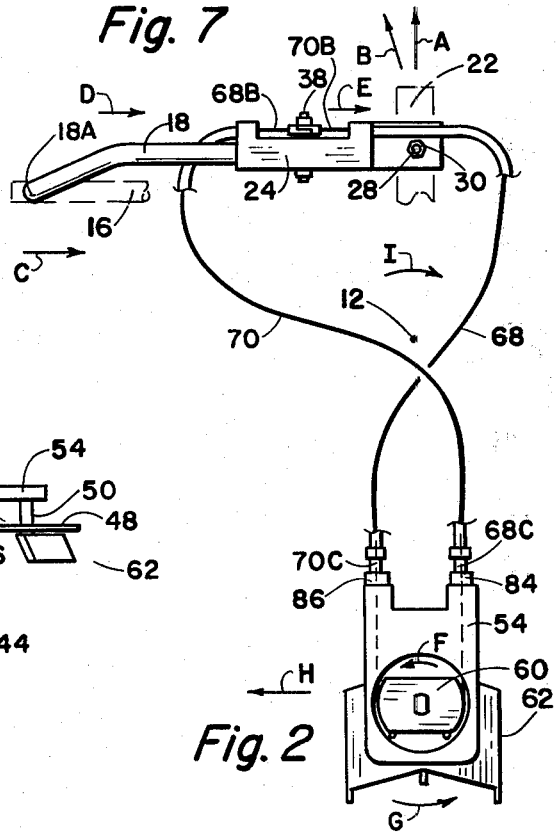
FIG. 2 is a top view of the apparatus of this invention for improving the steering of an outboard motor, the motor not being shown.
Figures 3, 3A, 4:
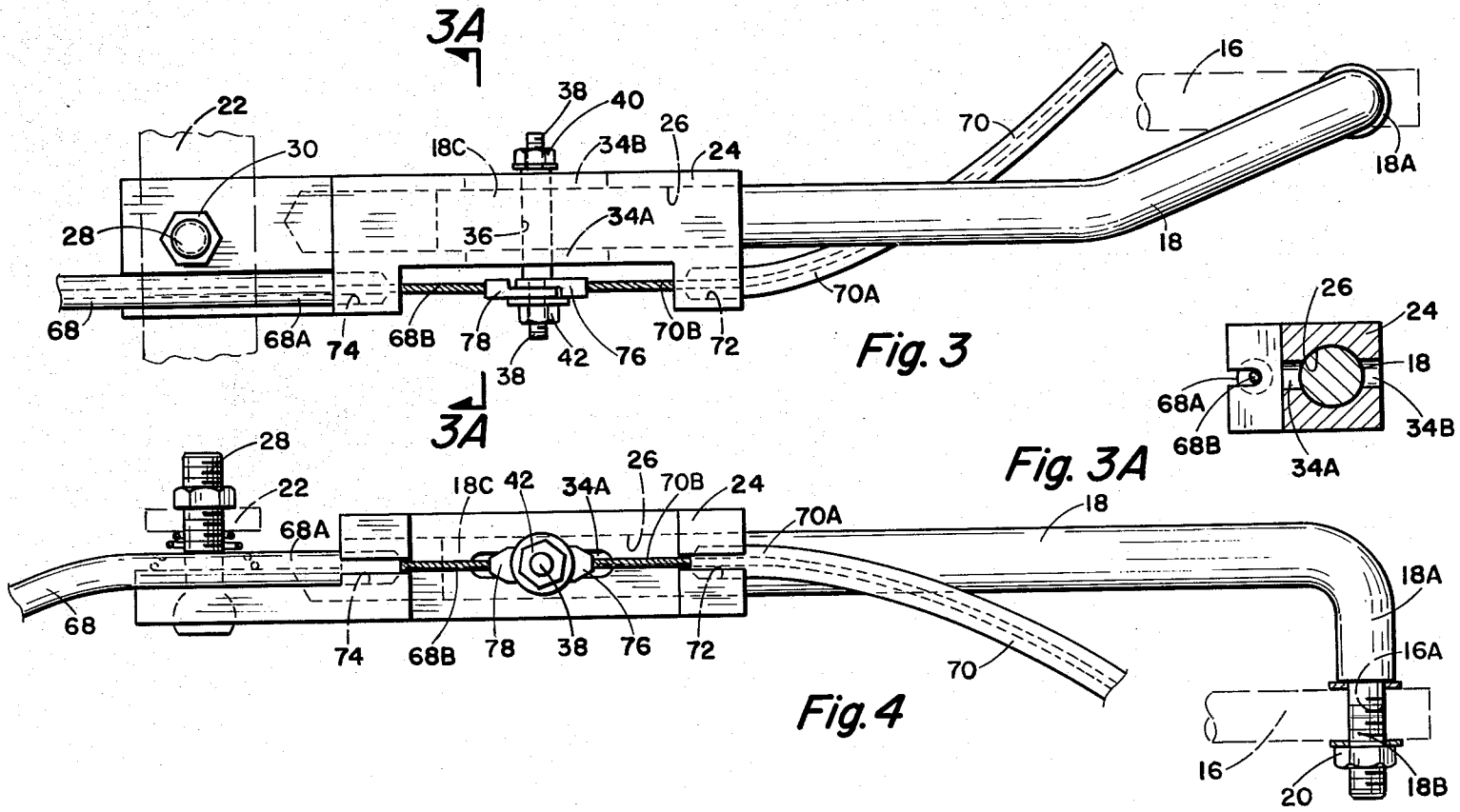
FIG. 3 is an enlarged plane view of the slide tube and link arm portions of the invention.
FIG. 3A is a cross-sectional view taken along the line 3A—3A of FIG. 3.
FIG. 4 is an elevational view of the slide tube and link arm as shown in FIG. 3.

Referring to FIG. 2, the mechanism of this invention is shown in plan view as employed on a motor. The motor is not shown, but it is understood that it pivots about axis 12. The steering linkage 16 as shown in dotted outline is that which is employed on the standard steering mechanism. Normally the linkage 16 is attached directly to the motor and reciprocates in a horizontal plane about axis 12 for rotating the motor to provide steering action. The invention employs a link arm 18 which has a first end 18A attached to the steering linkage 16. A method of attachment is shown in FIG. 4 in which the steering linkage 16 has an opening 16A therein receiving a reduced diameter portion 18B of the link arm which is threaded. A nut 20 retains the connection of the link arm to the steering linkage 16.

Referring back to FIG. 2, the boat motor 10 is provided with a tiller arm 22 (see also FIG. 1). Affixed to the tiller arm 22 is a slide tube 24. The slide tube has an opening 26 (see FIG. 3) therein which slidably receives end 18C of the link arm.

Slide tube 24 is affixed to the boat tiller arm 22 such as by means of a bolt 28 and nut 30. The invention is used, when attaching to standard outboard motor, by affixing the slide tube 24 to the tiller arm 22 in the same way that the standard steering linkage 16 is attached directly to the tiller arm.

Referring to FIGS. 3 and 4, slide tube 24 has opposed slots 34A and 34B which communicate with the horizontal opening 26, the slots extending in a plane of the axis of the opening 26 and through both opposed sides of the slide tube. The second end 18C of the link arm has an opening 36 which receives a bolt 38 extending through slots 34A and 34B. A nut 40 exterior of the slide tube slot 34B and a nut 42 exterior of slot 34A retain the bolt 38 in position. Thus it can be seen that the link arm 18 is slideably received within the slide tube 24; however, the limits of reciprocal motion of the link arm and slide tube are governed by the length of slots 34A and 34B.

Figure 7:
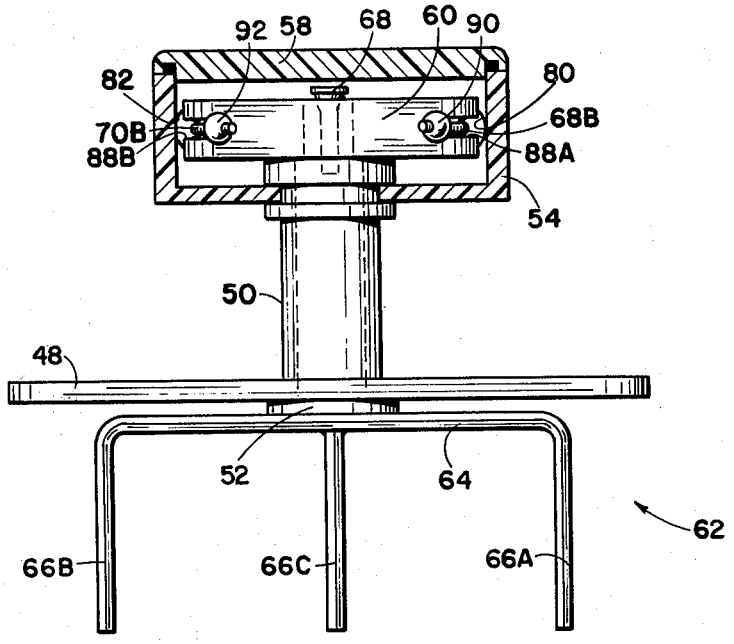
FIG. 7 is a rear view of the auxiliary fin and the fin actuator with the actuator housing shown in cross-section to reveal the actuator plate.

Referring again to FIG. 1, boat 10 has a propeller 44 and above it a cavitation plate 46. Affixed to the cavitation plate is an attachment plate 48, best shown in FIGS. 5, 6, and 7. Integrally extending upwardly from the top surface of the attachment plate is a tube 50 which rotatably supports a vertical shaft 52. At the upper end of tube 50 is a housing 54 having a recess 56 therein which is closed by a cover 58. Shaft 52 extends within the recess 56 and has affixed to it a horizontal actuator plate 60.

Affixed to the lower end of shaft 52, below the attachment plate 48, is a fin generally indicated by the numeral 62. In the preferred arrangement the fin includes a horizontal top fin plate 64 (see FIG. 7) and three paralleled equally spaced apart vertical fin plates 66A, 66B, and 66C. Further, the preferred arrangement has, as illustrated, the two outer vertical plates integrally formed with the top fin plate 64 and the middle fin plate 66C welded to the lower surface of the top fin plate. It can be seen that the fin 62 may be constructed wherein all of the vertical fin plates are welded to the top fin plate 66 or the fin 62 may be formed of an extrusion eliminating bending or welding in the fabrication of the fin.

Figure 5:
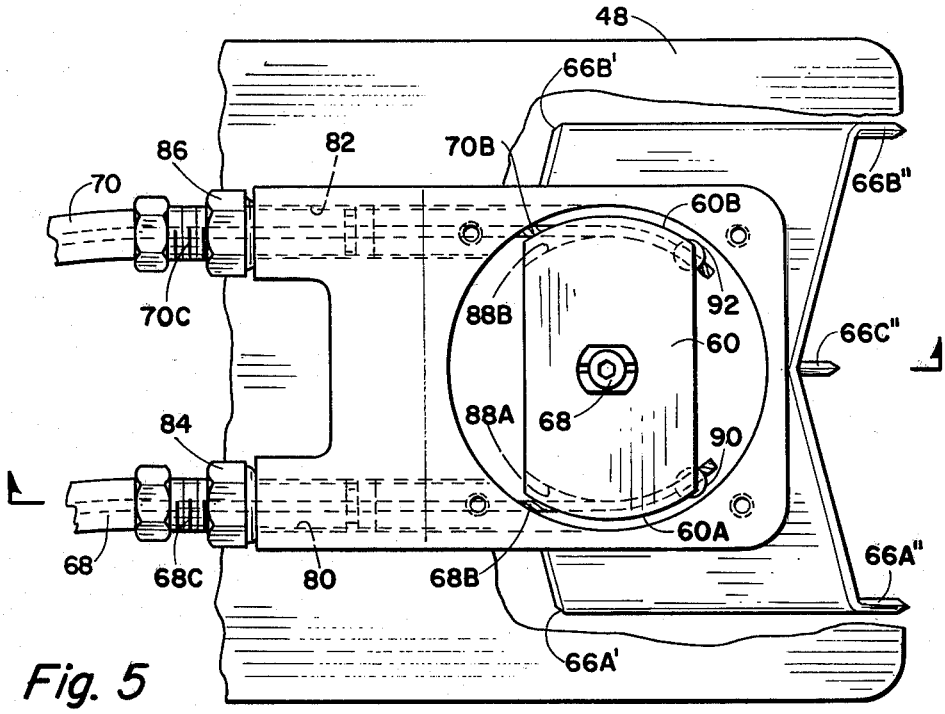
FIG. 5 is a plan view of the adapter plate, shown partially cut-away, supporting the auxiliary fin and the fin actuator housing. The top cover of the housing is removed to disclose the actuator plate.
Figure 6:
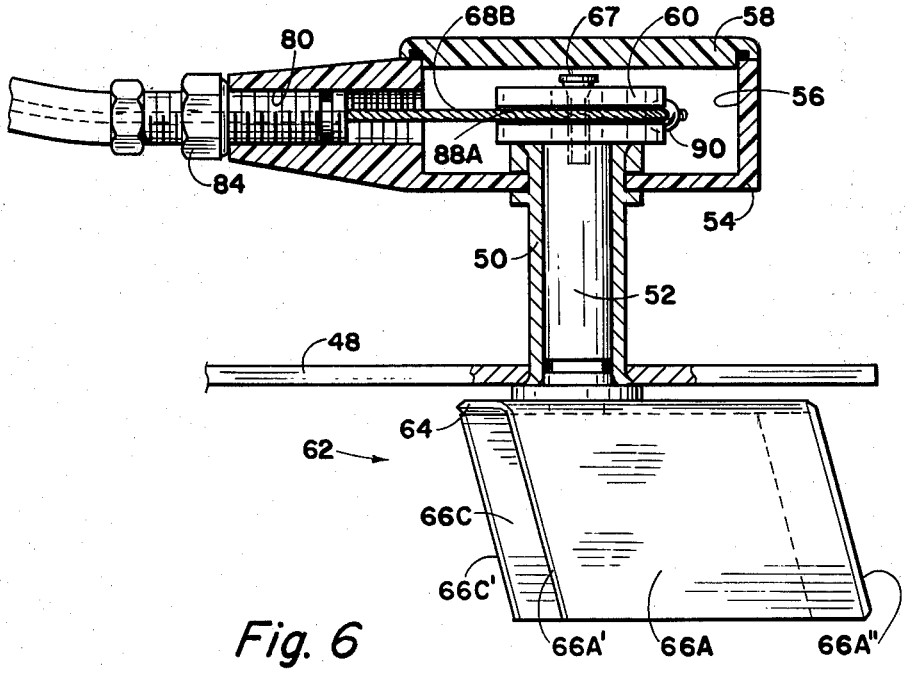
FIG. 6 is a cross-sectional view taken along the line 6—6 of FIG. 5, except the fin is shown in elevational view.

FIG. 6 shows the forward edge of vertical fin plate 66A identified by the numeral 66A′ and the forward edge of vertical fin 66C identified by the numeral 66C′. Each of the vertical fin plates has a trailing edge indicated in FIG. 5 by the numerals 66A″, 66B″, and 66C″. Preferably the trailing edges and forward edges of each of the vertical fin plates is sloped rearwardly in the downward direction as shown in FIG. 6. Forward edge 66C′ is advanced ahead of the forward edge 66A′ and 66B′, and in like manner, the rearward edge of the middle vertical plate 66C is advanced relative to the rearward edge of the outside vertical plates 66A and 66B.

Referring to FIG. 5 wherein cover 58 is removed from housing 54 to show the interior arrangement thereof. Affixed to the upper end of shaft 52, such as by means of a bolt 67, is the actuator plate 60 which has opposed peripheral surfaces 60A and 60B, each defined by circular portions equidistant from the axis of shaft 52.

Extending from the slide tube 24 to housing 54 are a pair of cables 68 and 70. Each cable includes an outer sheath indicated by the numerals 68A and 70A and an inner cable indicated by numerals 68B and 70B. The inner cables 68B and 70B are reciprocal relative to the outer sheaths 68A and 70A. Referring to FIGS. 3 and 4, the slide tube 24 has a pair of opposed aligned openings 72 and 74, the axis of the openings being in the horizontal plane of axial opening 26 which slidably receives the link arm 18 and also being in the same horizontal plane as bolt 38 received in slots 34A and 34B. One end of cable 70 is received in opening 72 and one end of cable 68 is received in opening 74. The ends of the cables attached to the slide tube 24 are thereby supported in a common plane extending in opposite directions from bolt 38. One end of each of the inner cables 68B and 70B is attached to the bolt 38 such as by means of lugs 76 and 78.

Referring now to FIGS. 5 and 6, housing 54 is provided with spaced apart parallel horizontal openings 80 and 82 which receive the other ends of cables 68 and 70. The cables are provided at the ends received by housing 54 with rigid externally threaded tubular portions 68C and 70C. The tubular portions 68C and 70C are, in effect, continuations of the cable external sheaths 68A and 70A. The threaded tubular portions 68C and 70C of the cables slidably extend in the housing openings 80 and 82. Received on tubular portion 68C is a nut 84, and in like manner, received on tubular portion 70C is a nut 86. Nuts 84 and 86 are tensioning nuts.

The inner cables 68B and 70B attach to the peripheral surfaces 60A and 60B of the actuator plate. The opposed semi-circular peripheral portions 60A and 60B of the actuator plate have grooves 88A and 88B therein which receive the cable inner portions 68B and 70B. A lug 90 secures the end of inner cable 68B and retains it in the groove 88A of the actuator plate peripheral surface 60A; and, in like manner, lug 92 secures one end of inner cable 70B within the groove 88B of the actuator plate semi-circular peripheral surface 60B.

When the cables are in position, tension may be applied by adjusting nuts 84 and 86 so that the cable inner portions 68B and 70B are under a preselected tension. In this manner, any slight movement of link arm 18 relative to slide tube 24 will result in rotation of actuator plate 60 and consequently shaft 52 and fin 62. If the slide tube 24 and link arm 18 move simultaneously; that is, where there is no relative motion between the two, then there is no motion transferred to fin 62.

OPERATION

When a steering action takes place by the longitudinal displacement of steering linkage 16, such motion is directly transferred to link arm 18. The motion of steering linkage 16 is intended to rotate motor 10 about its vertical axis 12. When the motor is of large horsepower, much force is applied to the supporting structure between the motor and its mount and much torque may be required to rotate the motor. In addition, the torque of the propeller 44 when driven by large horsepower can cause steering to be difficult and thus large motors require a substantial amount of physical exertion to provide the necessary force to rotate the motor to achieve steering control. With the present invention, however, movement of the link arm 18 does not directly transfer force to rotate motor 10 about its axis but instead, since the link arm is slidably received in the tube 24, sliding action takes place. This sliding motion constitutes a relative movement of bolt 38 relative to the slide tube, which motion is transferred to the inner cables 68B and 70B. Any slight movement of the link arm relative to the slide tube causes the cables to transmit the motion to fin 62. This causes the fin to rotate slightly. The direction of rotation of the fin is such as to apply a rotational torque to the motor as a consequence of the reaction of the fin to the propeller slip stream.

Referring to FIG. 2, assuming the intent is to turn the boat from a straight-ahead direction to the left, that is, from a direction indicated by arrow A towards a direction indicated by arrow B. To achieve this change in direction of the boat to which the motor is attached (the boat not being shown), it is necessary to rotate the motor around axis 12 in the clockwise direction. Therefore, the steering action of steering linkage 16 is in the direction indicated by the arrow C. This motion is imparted to the link arm 18 to move it in the direction indicated by arrow D. The link arm 18 will slide in slide tube 24 moving bolt 38 and thereby cable inner portions 68B and 70B in a direction indicated by arrow E. The cable inner portions transmit this movement to the actuator plate 60 and thereby to the fin 62 to cause these members to rotate in the directions indicated by the arrows F and G. The slip stream of water moving past fin 62 supplies a force in the direction indicated by the arrow H which functions as a moment arm around motor axis 12, rotating the motor in a direction indicated by the arrow I. Thus, the fin 62 does the work of moving the motor. Since the fin is designed for balance loading, the energy required to rotate the fin is relatively small compared to that to rotate the motor, however, the fin positioned in the slip stream of the motor propeller exerts ample force to easily rotate the motor about its axis 12 to achieve the steering direction. When the motor rotates, it will move the slide tube 24 relative to the link arm 18 to re-center bolt 38 in slots 34A and 34B.

In the event insufficient force is developed by the fin to move the motor which may occur, if the bolt is traveling at a slow speed, further lateral displacement of the link arm 18 will cause the bolt 38 to engage one or the other of the ends of the slots 34A and 34B so that direct steering force is applied from the steering linkage 16 of the tiller arm 22. In this manner, final control is provided between steering linkage 16 and tiller arm 22, to insure safety of operation of the device.

ALTERNATE EMBODIMENT

Figure 8:
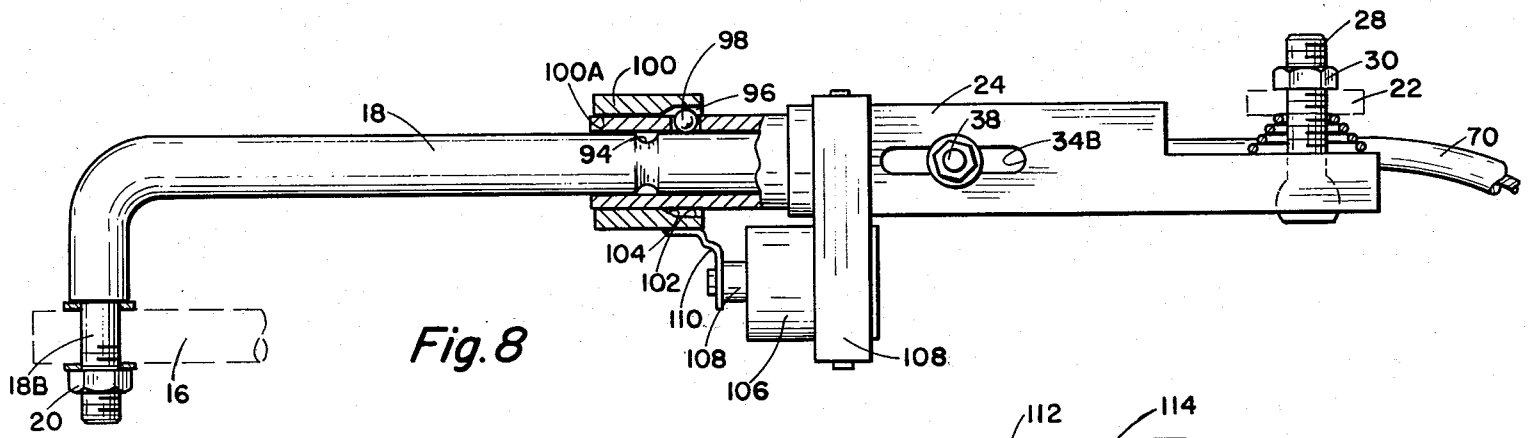
FIG. 8 is an elevational view, shown partially in cross-section, of an alternate embodiment of the invention, including means for selectably locking the link arm to the slide tube so that, in such condition, the steering of the boat utilizing the device is directly coupled to the motor and the motor is steered in the normal manner.

FIGS. 8–11 disclose means whereby the operator of a boat employing the invention may optionally select a mode wherein the steering is directly coupled to the motor, as in the present means of steering boats, or wherein the means of the present invention of reducing the force required to steer the boat may be employed. Referring first to FIG. 8, the slide tube 24 and link arm 28 are shown and operate in the method illustrated and described with respect to FIGS. 3 and 4. The link arm 18 has a groove 94. Slide tube 24 has an opening 96 which receives a ball 98. Slidably positioned around the exterior of slide tube 24 is a collar member 100. Adjacent one end of the collar member is an enlarged internal diameter portion 102 which provides an internal shoulder 104.

When the collar 100 is in the position wherein the enlarged diameter portion 102 is aligned with opening 98, the link arm 18 is free to slide back and forth within the slide tube 24. When groove 94 passes opening 96, the ball 98 falls in but is raised out again as the movement of arm 18 continues. However, it can be seen that if collar 100 is moved to the right so that the normal internal diameter portion 100A is above opening 96 then ball 98 will be held in groove 94 and the link arm 18 and slide tube 24 will then be locked together. Any motion transmitted by the link arm 18 is directly transmitted to slide tube 24 and thereby to the motor tiller arm 22; thus the improved steering apparatus of this invention is deactivated and no relative motion can exist between the link arm 18 and slide tube 24 to rotate fin 62. In this mode fin 62 remains in the same alignment relative to the propeller assembly regardless of the turning motion applied to link arm 18.

Collar 100 may be manually positioned to either lock or unlock the link arm 18 to the slide tube 24 or, as illustrated in FIG. 8, the position of collar 100 may be controlled electrically such as by means of a solenoid 106 secured by band 108 to the exterior of the slide tube 24. Solenoid 106 has plunger 109 extending therefrom which is attached by bracket 110 to collar 100. When solenoid 106 is energized, plunger 109 tends to be withdrawn and thereby urges collar 100 in the direction towards the right. As soon as the link arm 18 is moved such that the groove 94 therein is in alignment with opening 96, ball 98 is urged into it and the collar is then free to move in response to the force imparted by the solenoid so that the normal internal diameter portion 100A maintains the ball in the groove 94, locking the arm to the slide tube.

Figure 9:
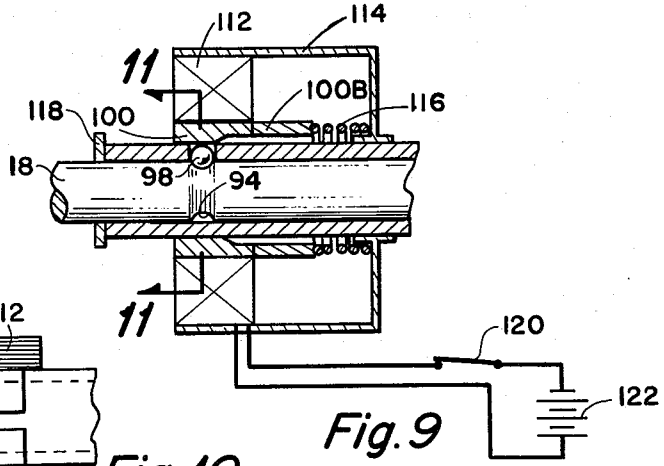
FIG. 9 is a cross-sectional view of a portion of the slide tube and link arm showing an alternate arrangement wherein a solenoid may be used to selectably lock the slide tube to the link arm for normal steering operation.

FIG. 9 shows an alternate arrangement of that of FIG. 8. In this arrangement a solenoid 112 is supported concentrically about collar 100, the solenoid being held in place by circumferential bracket 114. The collar 100 has a non-paramagnetic extension 100B. A spring 116 normally urges collar 100 in a direction towards the left, but when solenoid 112 is energized, as in the condition shown in FIG. 9, the collar is urged to the right, compressing the spring 116, and locking link arm 18 to slide tube 24. A stop 118 limits the movement of collar 100 when the solenoid 112 is de-energized. A switch 120 in series with voltage source 122 is used to control solenoid 112. When the operator wants the power steering assist provided by this invention activated, switch 120 is opened, allowing collar 100 to move to the left by the force of spring 116. The slide tube 24 then is free to move relative to the link arm 18 thereby actuating the fin to apply rotational torque to turn the propeller assembly.

Figure 10:
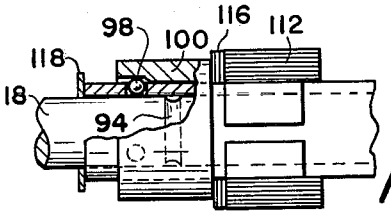
FIG. 10 is a view as shown in FIG. 9 showing an alternate arrangement of the solenoid for optionally controlling steering.
Figure 11:
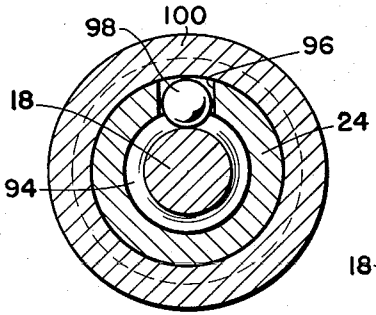
FIG. 11 is a cross-sectional view taken along the line 11—11 of FIG. 8.

FIG. 10 is an alternate arrangement of FIG. 9 in which the solenoid 112 is supported on the slide tube 24 in tandem with collar 100. When the solenoid 112 of FIG. 10 is energized, it moves the collar 100 to the right, compressing spring 116 and placing the steering device in the power assist mode, whereas when the solenoid is de-energized, the collar 100 moves to the left, forcing ball 98 into the groove, locking the link arm 18 to the slide tube 24 and deactivating the power assist fins. Thus in the arrangement of FIG. 9, the solenoid is energized to deactivate the power assist device whereas in FIG. 10 the solenoid is energized to achieve power assist.

As previously indicated, collar 100 may be moved manually to either activate or deactivate the power assist or it may be moved electrically as illustrated in FIGS. 8, 9, and 10. It can equally as well be activated hydraulically such as in FIG. 8 by replacing solenoid 106 with a hydraulically actuated cylinder. Any method of remotely controlling the movement of the collar 100 would be within the purview of this invention.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification but is to be limited only by the scope of the attached claim or claims, including the full range of equivalency to which each element thereof is entitled.

What is claimed is:

1. For use with a boat of the outboard or inboard-outboard type having a reciprocal boat steering means and wherein a propeller assembly is turned about a vertical axis to steer, an improved means for reducing the force required to steer the boat, comprising:

a slide tube;

a link arm having one end thereof slidably received in said slide tube;

means for connecting said tube and link arm between the boat steering means and the boat propeller assembly;

a fin supported on the bottom of a vertical shaft, the shaft being rotatably supportable to a propeller assembly whereby the fin is positioned in the propeller slip stream;

a horizontal actuator plate affixed to the shaft upper end;

means to couple said horizontal actuator plate to respond to the relative slidable position of said slide tube and said link arm;

and means for selectably locking said link arm to said slide tube whereby displacement of the boat steering means directly rotates the propeller assembly.

2. An improved boat steering means according to claim 1 wherein said means for selectably locking said link arm to said slide tube includes electrical means.

3. An improved boat steering means according to claim 1 wherein said slide tube has a radial opening therein, and wherein said link arm has a notch therein in the portion received by said slide tube, and including:

a ball carried in said radial opening in said slide tube of a diameter greater than the thickness of the slide tube wall; and a sleeve coaxially and slidably received on said slide tube, whereby when said notch in said link arm is aligned with said radial opening in said slide tube said ball can partially enter said slot and said sleeve can be slidably advanced over said radial opening to retain said ball partially in said link arm notch.

4. An improved boat steering means according to claim 3 wherein said means for slidably advancing said sleeve includes electrical solenoid means.

5. An improved boat steering means according to claim 1 wherein said fin comprises:

a horizontal top plate having said vertical shaft extending from the upper surface thereof; and three paralleled equally spaced apart vertical plates extending downward from said top plate, providing a center plate and two outside plates, each vertical plate having a forward edge and a trailing edge, and wherein the forward edge and the trailing edge of each vertical plate are sloped rearwardly in the downward direction, and wherein the forward edge of the center plate is forwardly advanced relative to the forward edges of the outside plates.

6. An improved boat steering means according to claim 5 in which said two outside plates are integrally formed with said top plate and said center plate is welded to said top plate.

7. An improved boat steering means according to claim 1 wherein said slide tube has a horizontal opening therein, the slide tube having means for attachment to the propeller assembly for applying steering force thereto, the slide tube having a slot therein communicating with the horizontal opening, and wherein said link arm has one end thereof slidably received in said opening in said slide tube, the other end having means for attachment to the boat steering means whereby the link arm is displaced axially in a horizontal plane for steering the boat, and wherein said horizontal actuator plate has a peripheral surface defined by opposed circular portions equidistant from the shaft axis, and wherein said means to couple said horizontal actuator plate to respond to the relative slidable position of said slide tube and said link arm comprises:

a pin affixed to said link arm and extending through said slot in said slide tube;

a first cable having one end attached to said pin and extending in a horizontal plane and perpendicular said pin in one direction;

a second cable having one end attached to said pin and extending in a horizontal plane and perpendicular said pin in the opposite direction, the other end of said first cable being attached to said horizontal plate at one end of said circular peripheral portion and the other end of said second cable being attached to said horizontal plate at the other end of said circular peripheral portions.

8. For use with a boat of the outboard or inboard-outboard type having a reciprocating boat steering means and a propeller assembly which is rotated about a vertical axis to steer the boat, an improved means for reducing the force required to steer the boat comprising:

coupling means connecting the reciprocating boat steering means to the propeller assembly permitting limited movement of the steering means before rotation of the propeller assembly;

a fin supported on the bottom of a vertical shaft, the shaft being rotatably supported to the propeller assembly, whereby the fin is positioned in the propeller slip stream;

a horizontal actuator plate affixed to the shaft upper end;

means to connect said horizontal actuator plate to said coupling means whereby when said boat steering means is displaced, said fin is rotated to apply steering force to the propeller assembly, when a slip stream exists, before the steering means applies force directly to rotate the propeller assembly; and means controllable remotely from said coupling means for selectably locking the boat steering means to the propeller assembly whereby displacement of the boat steering means directly rotates the propeller assembly.

9. An improved boat steering means according to claim 8 wherein said means for selectably locking the boat steering means to the propeller assembly includes electrical means.

10. An improved boat steering means according to claim 8 wherein said fin comprises:

a horizontal top plate having said vertical shaft extending from the upper surface thereof; and three paralleled equally spaced apart vertical plates extending downward from said top plate, providing a center plate and two outside plates, each vertical plate having a forward edge and a trailing edge, and wherein the forward edge and the trailing edge of each vertical plate are sloped rearwardly in the downward direction, and wherein the forward edge of the center plate is forwardly advanced relative to the forward edges of the outside plates.

11. An improved boat steering means according to claim 10 in which said two outside plates are integrally formed with said top plate and said center plate is welded to said top plate.

* * * * *